US008955273B1

(12) United States Patent
Lehane, Jr. et al.

(10) Patent No.: US 8,955,273 B1
(45) Date of Patent: Feb. 17, 2015

(54) CHANNEL CROSS MEMBER

(71) Applicant: USG Interiors, LLC, Chicago, IL (US)

(72) Inventors: James J. Lehane, Jr., McHenry, IL (US); Peder J. Gulbrandsen, Aurora, IL (US); Mark R. Paulsen, Waukegan, IL (US); Abraham M. Underkofler, Waukegan, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 13/960,068

(22) Filed: Aug. 6, 2013

(51) Int. Cl.
*E04C 2/52* (2006.01)
*E04B 9/12* (2006.01)
*E04B 9/14* (2006.01)

(52) U.S. Cl.
CPC .. *E04B 9/122* (2013.01); *E04B 9/14* (2013.01)
USPC ..... 52/220.6; 52/506.07

(58) Field of Classification Search
CPC ..... E04B 9/122; E04B 9/18; E04B 9/068; E04B 9/067; E04B 9/006; E04B 9/127
USPC ..... 52/220.6, 506.06–506.1; 403/276, 403/278–283, 285
See application file for complete search history.

(56) References Cited

U.S. PATENT DOCUMENTS 3,084,401 A * 4/1963 Findlay ..... 52/476
3,096,862 A * 7/1963 Purdy ..... 52/665
3,189,139 A * 6/1965 Znamirowski et al. .... 52/506.07
3,239,035 A * 3/1966 Znamirowski ..... 403/219
3,288,489 A * 11/1966 Jahn ..... 403/285
3,367,695 A * 2/1968 Haertel et al. ..... 403/219
3,396,997 A * 8/1968 Adams ..... 403/326
3,457,688 A * 7/1969 Znamirowski et al. .... 52/506.07
3,846,031 A * 11/1974 Adams ..... 403/28
3,890,760 A * 6/1975 Jones ..... 403/360
4,086,480 A * 4/1978 Lahm ..... 362/148
4,281,446 A * 8/1981 Umeno ..... 29/432.1
RE31,201 E * 4/1983 Sauer ..... 52/667
4,481,745 A * 11/1984 Smits et al. ..... 52/220.6
4,525,973 A * 7/1985 Vukmanic et al. ..... 52/667
4,601,153 A * 7/1986 Dunn et al. ..... 52/666
4,730,433 A * 3/1988 Ollinger et al. ..... 52/506.07
4,827,681 A * 5/1989 Platt ..... 52/98
4,912,894 A * 4/1990 Platt ..... 52/98
4,989,387 A * 2/1991 Vukmanic et al. ..... 52/667
5,517,796 A 5/1996 Koski et al.
5,687,525 A * 11/1997 Koski et al. ..... 52/506.07
5,761,868 A 6/1998 LaLonde et al.
5,904,025 A * 5/1999 Bass et al. ..... 52/741.3

(Continued)

FOREIGN PATENT DOCUMENTS

EP 281170 A1 * 9/1988 ..... E04B 5/55
EP 301658 A1 * 2/1989 ..... E04B 5/55

*Primary Examiner* — Adriana Figueroa
(74) *Attorney, Agent, or Firm* — Pearne & Gordon LLP

(57) ABSTRACT

A short cross member for a narrow utility channel formed of malleable sheet metal and having a vertical double ply web and a horizontal flange symmetrically disposed on both sides of a lower edge of the web, integral end connectors formed on each end of the cross member from sheet material contiguous with the web, the integral end connectors being arranged to support the flange in coplanar relation with flanges of the channel, the end connectors and the web being weakened at a predetermined vertical line whereby the cross member can be assembled in a narrow channel by bending at the associated line of weakness to shorten the effective overall length of the cross member.

3 Claims, 3 Drawing Sheets

(56) References Cited

U.S. PATENT DOCUMENTS 6,288,469 B1 * 9/2001 Kimura et al. ..... 310/239
6,374,564 B1 * 4/2002 Fletterick et al. ..... 52/506.07
6,851,238 B2 * 2/2005 Rebman ..... 52/506.07
7,661,236 B2 * 2/2010 Platt et al. ..... 52/506.06
8,286,948 B2 * 10/2012 Williams ..... 256/21

* cited by examiner

CHANNEL CROSS MEMBER

BACKGROUND OF THE INVENTION

The invention relates to suspended ceiling construction and, in particular, to grid elements used with narrow utility channel systems.

PRIOR ART

Narrow channel systems are available for housing or otherwise locating various utility hardware in a conventional rectangular ceiling grid and tile construction. The channels are viewed as more harmonious or attractive than conventional arrangements for locating lights, air diffusers and returns, sprinklers and the like. Conventional arrangements, for example, dedicate a full grid module space to a single utility and, consequently, are more visually prominent than what is needed to ordinarily house a particular utility. The subject narrow channel systems, besides reducing the visibility of necessary utilities, can add to the attractiveness of a ceiling.

It is known to construct narrow utility channels by aligning a pair of conventional main runners or tees in close parallel relation. A number of inverted U-shaped yokes, spaced along the length of these main tees can be used to hold these main tees in parallel channel-forming relation at the ceiling plane. The yokes are located above the zone of the channel to provide space for utility hardware. This type of construction presents a need for a manner of trimming the ends of the hardware located in the channel such as panels, lights, grilles or the like. Use of short cross runners or tees with conventional end connectors for this purpose has proven to be difficult if not impractical.

SUMMARY OF THE INVENTION

The invention provides a cross member for narrow suspended ceiling channels useful for trimming the ends of typical components assembled in the channels. The inventive cross members can be used in different modes depending, inter alia, on whether a cross runner slot of a main runner forming a side of the narrow channel is occupied.

Cross runner slots of main runners or tees forming a narrow channel can be occupied by a yoke that holds the tees in channel forming relation, by an end connector of an intersecting grid cross runner or tee, or can be unoccupied. The disclosed cross member can be field modified to be connected to a tee supporting yoke at a cross tee slot, or can be mated directly with an end connector of an intersecting grid tee at a cross tee slot, or can be installed and locked in an otherwise unoccupied cross tee slot.

The disclosed cross member is conveniently produced from grid tee stock ordinarily used in the manufacture of standard tees. Consequently, no special tooling or manufacturing procedures need be used to produce the tee stock for the inventive cross members. Lengths of the tee stock are cut into short pieces with a stamping die. The stamping die simultaneously cuts a shaped second or trailing end of one cross member as that piece is being completed and a shaped first or leading end of a next succeeding cross member piece to be formed. The shaped ends serve as integral end connectors.

The cross member integral end connectors, which are identical, have several features that can facilitate installation and connection with various elements. The integral end connectors can clip onto opposed standard end connectors of intersecting cross tees. Alternatively, the integral end connectors are easily trimmed to avoid interference with a web of a main tee when connected to a yoke. The integral end connectors, additionally, have an aperture located to facilitate a connection with a yoke or, alternatively, enable the end to be temporarily bent to facilitate assembly into a narrow channel. The integral end connectors are double plies of malleable sheet metal; the plies can be separated and folded tightly against the web of a main tee to lock an end connector in an otherwise unoccupied cross tee slot.

DESCRIPTION OF THE PREFERRED EMBODIMENT

Figure 1:
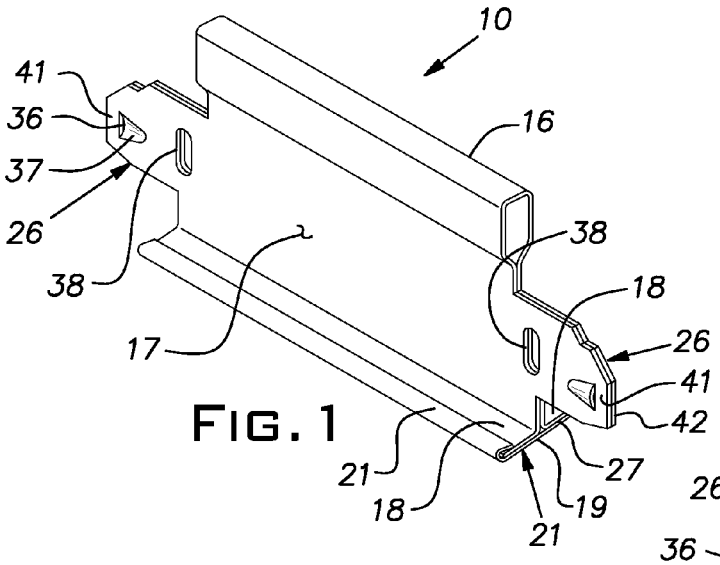
FIG. 1 is a perspective view of a channel cross member constructed in accordance with the invention.
Figure 2:
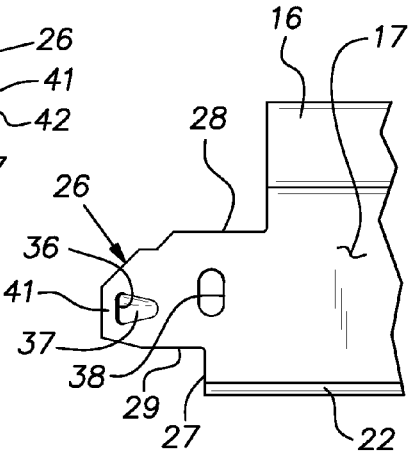
FIG. 2 is a fragmentary side view of an end of the cross member.

FIG. 1 illustrates a cross member 10 embodying the invention used in a narrow channel 11 depicted in FIG. 2. The channel 11 is employed as a part of a suspended ceiling grid to support utilities. The channel 11 is typically used with identical channels in spaced parallel lines across a ceiling. The channel 11 affords a popular ceiling treatment because it deploys utility hardware in a package that is less obtrusive than hardware that occupies a full grid module, which ordinarily is 2 foot by 2 foot or 2 foot by 4 foot (or industry metric equivalents thereof).

The channel 11 is formed by a pair of closely spaced parallel main runners or tees 12 of conventional construction used in a suspended ceiling grid. A center-to-center spacing of 4 inches or 6 inches (with metric equivalents of 100 mm. and 150 mm.) of the channel forming main tees 12 is standard in the industry. Channels 11 are normally arranged to extend transversely from wall-to-wall. Space inside the channel 11 is used to house utility components such as light fixtures, air diffusers, air returns, sprinkler heads and the like. These devices are ordinarily of a length less than the length of a channel and, therefore, require a trim member across the width of a channel 11 to give the utility component a finished appearance at the ceiling plane. The cross member 10 can be used to conceal or trim the longitudinal ends of utility components and any filler panels interposed between such components. It is desirable that the cross members have the same appearance as the elements forming the surrounding ceiling grid and are aligned with such elements. Use of special short length grid tees with conventional separately formed end connectors for channel cross members has been found to be prohibitively expensive and such tees are difficult if not impossible to install without damage after a channel 11 has been erected in a grid system.

The cross member 10 of the invention is preferably cut from a length of the grid stock ordinarily used to produce 2 or 4 foot (or metric equivalent) cross tees. The stock is roll formed sheet metal. A main body of the tee stock comprises an upper hollow reinforcing bulb 16, a double ply web 17, and lower opposed flange elements 18 all formed from a single metal strip. A flange cap 19 covering the opposed flange elements 18 is formed of a separate sheet metal strip. The strips are held in assembled relation by longitudinal hems 21 of the flange cap 19 folded over longitudinal edges of the flange elements 18. The flange elements 18 and flange cap 19 form a lower flange 22 of the tee stock. The cross member 10 departs from current industry cross tee construction using separate end connectors. The ends of the inventive cross member 10 are die cut with integral end connectors or tongues 26 formed from areas of the double ply web 17.

Each longitudinal end edge 27 of the flange 22 of a cross member 10 lies in the plane of the flange. The integral end connector 26 has a profile with upper and lower edges 28, 29 configured to be received in a standard cross tee slot 31 of a main tee 12 with the flange 22 of the cross member 10 coplanar with a main tee flange 32 and the flange end edge 27 abutting the longitudinal edge of the main tee flange.

Referring in particular to FIG. 2, the integral end connector 26 is lanced to one side, above the plane of the drawing of FIG. 2, to create an internal rearwardly facing edge 36 and a pocket 37 behind the edge in the area vacated by the lanced material. As indicated in FIG. 1, the integral end connectors 26 on the ends of the cross member 10 are identical. Rearward of the pocket 37 at a predetermined location relative to the edge 36 an oblong hole or vertical slot 38 is punched through the plies of the integral end connector 26. The location of the flange end edge 27 relative to the integral end connector 26 depends on the width of the main tee flange 32. Normally, the width of the cross member flange 22 will be the same as the width of the main tee flange 32.

The main tees or runners 12 forming the channel 11 have their cross tee slots 31 in alignment. In the present embodiment, the cross tee slot 31 is of the type disclosed in U.S. Pat. Nos. 5,517,796 and 5,761,868. As will be discussed, the cross members 10 can be assembled in a pair of opposed slots 31 either or both being empty or occupied by an end connector of an intersecting cross tee 45.

Figure 3:
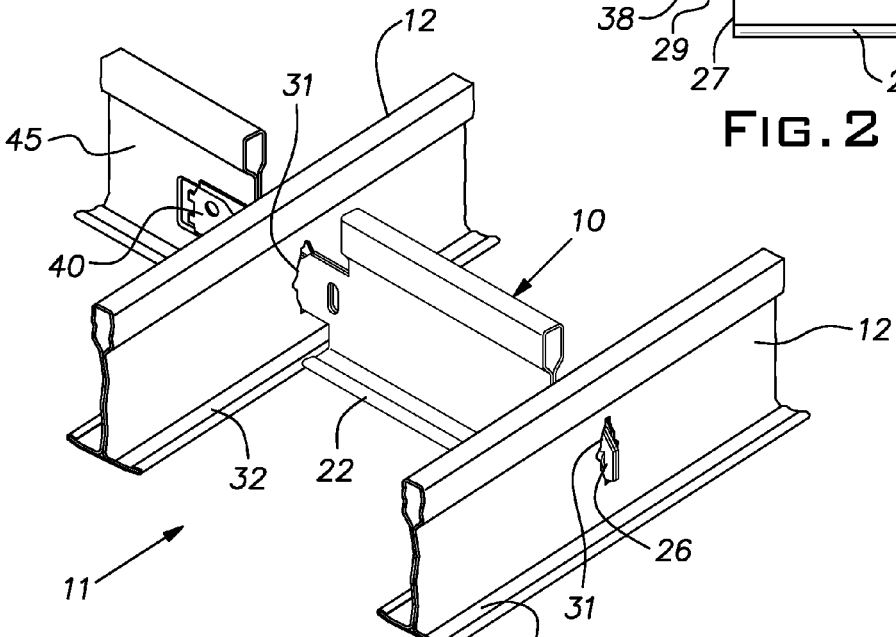
FIG. 3 is a fragmentary perspective view of the cross member assembled in a channel.

FIG. 3 illustrates the cross member 10 with its integral end connectors 26 disposed in a pair of cross tee slots 31 of the main tees 12 forming the channel 11. The proportions illustrated are that of a 4 inch channel. When the cross member 10 is properly assembled in the channel 11, both end edges 27 of its flange 22 butt against respective longitudinal edges of the main tee flanges 32. The cross member 10 in this position can produce a finished look to the end of a utility device or panel disposed in the channel 11.

The cross member 10 can be located at a cross tee slot 31 in which an end connector 40 of an intersecting cross tee 45 is received. Visually, this produces an uninterrupted line across the channel 11 when the suspended ceiling grid is viewed from below.

Figure 6:
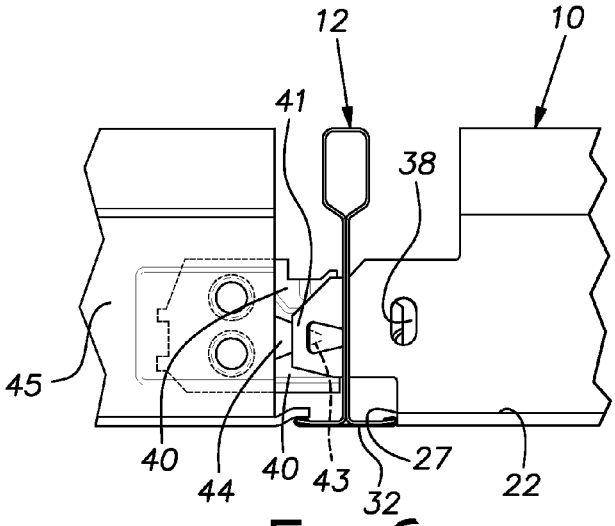
FIG. 6 is a fragmentary side elevational view of a cross member connected to an intersecting cross tee end connector.

The integral end connector 26 is arranged to mate with the type of cross tee end connector 40 disclosed, for example, in the aforementioned U.S. patents. A vertical strap 41 exists between a lead edge 42 of the integral end connector 26 and the lance edge 36. The strap 41 is arranged to fit between a pair of opposed projections 43, 44 of the end connector 40 of an intersecting cross tee 45 (FIG. 6) and the forward projection 43 is received in the pocket 37 of the integral end connector 37. There results a positive connection between the integral end connector 26 and cross tee end connector 40.

Figure 4:
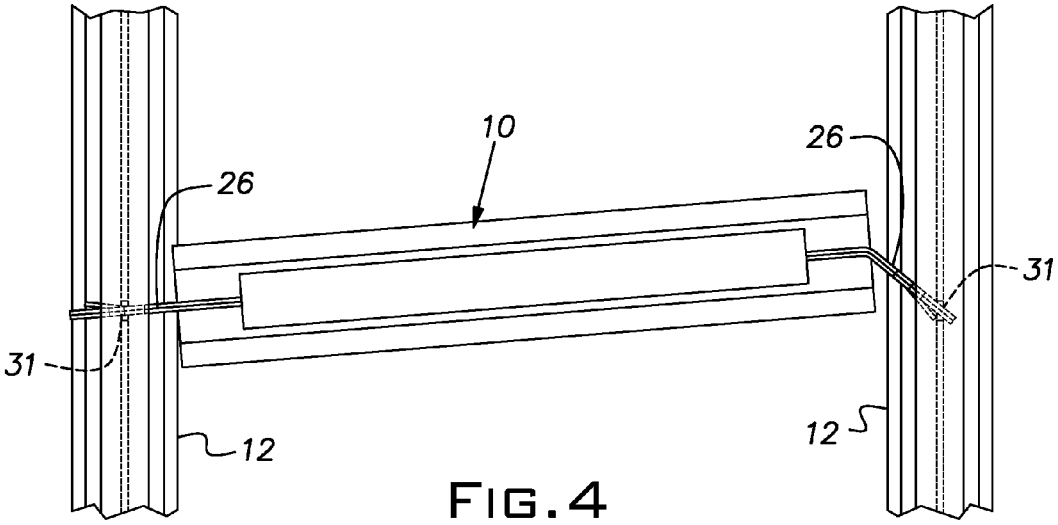
FIG. 4 is a diagrammatic plan view illustrating a manner of assembling the cross member in a channel.

Normally the channel 11 is constructed before the cross members 10 are installed. Consequently, the center-to-center distance between the main runners 12 of the channel 11 is fixed. The inventive cross member 10 facilitates its assembly into an established channel 11. With reference to FIG. 4, one integral end connector 26 of a cross member 10 is bent at a vertical line through the oblong vertical hole 38. The existence of the hole or slot 38 weakens the juncture between the integral end connector 26 and the cross member 17 so that the hole determines a bend or fold line. FIG. 4 diagrammatically illustrates the assembly of a cross member 10 into opposing slots 31 of the main tees 12. With the cross member 10 diagonally oriented to the tees 12, an unbent integral end connector 26 is inserted in a first one of the slots 31. The opposite integral end connector 26 is bent at the hole 38 out of plane of the cross member web 17 in a direction towards the slot 31 into which it is to be installed. The bent integral end connector 26 is caused to enter the intended slot 31 and as the cross member 10 is moved into a final perpendicular position, the bent integral end connector is fully received in the respective slot. If an end connector 40 of an intersecting cross tee 45 exists in a slot 31, the cross tee end connector will help register the integral end connector 26 with the slot. The intersecting cross tee end connector 40 is made of relatively stiff material, and will tend to re-bend the integral end connector 26 into alignment with its web 17.

Figure 5:
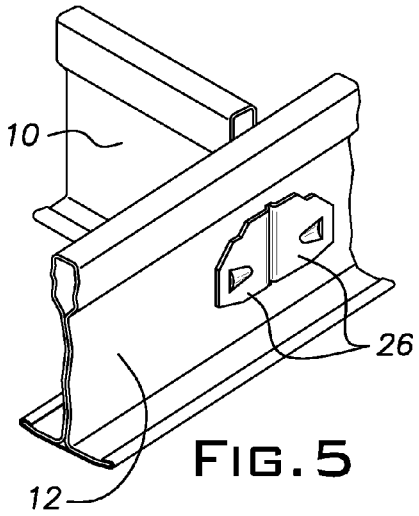
FIG. 5 is a fragmentary perspective view of an end of a cross member attached to a main tee forming one side of a channel.

When a cross member 10 is assembled in a cross tee slot 31 that is otherwise unoccupied, the two plies of the integral end connector 26 can be manually pried apart with a flat blade screwdriver or like tool. The plies, thereafter, can be bent flat against the main tee web with a suitable tool, such as a small hammer or mallet. This situation is illustrated in FIG. 5.

Figure 7:
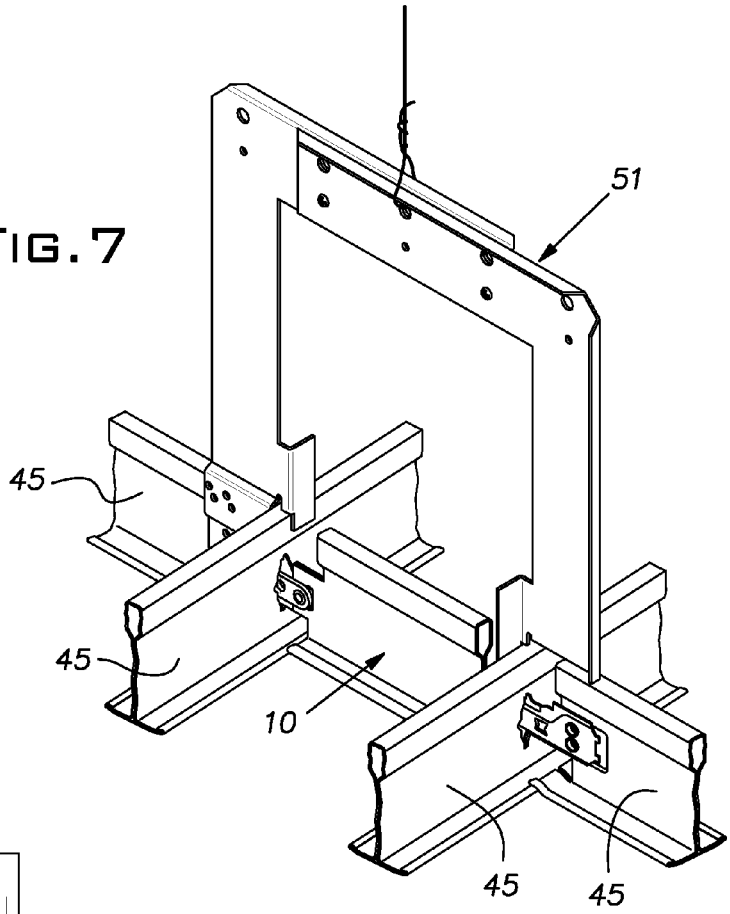
FIG. 7 is a fragmentary perspective view of an assembly of the cross member with a yoke used to construct a channel.
Figure 8:
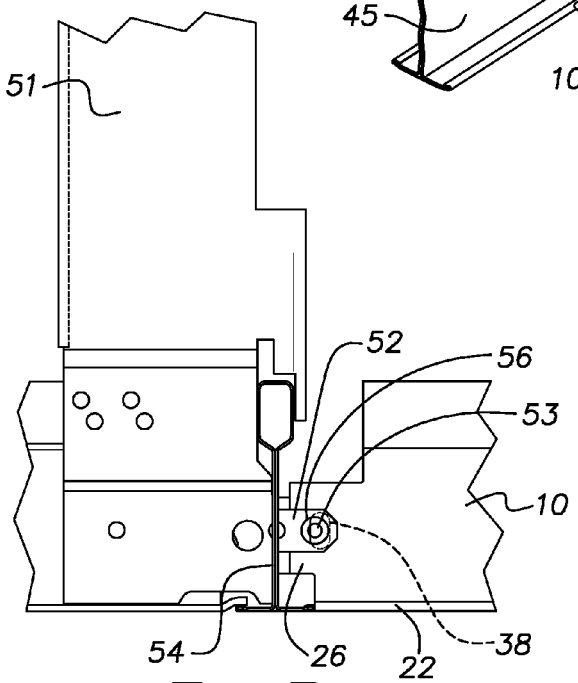
FIG. 8 is a fragmentary side elevational view on an enlarged scale of an end of a cross member joined to the yoke of FIG. 7.

FIGS. 7 and 8 illustrate installation of a cross member 10 at cross tee slots 31 occupied by a yoke 51 used to maintain the tees 12 in their channel-forming relative positions. U.S. patent application Ser. No. 13/488,474, filed Jun. 5, 2012 discloses the illustrated yoke 51. As suggested in FIG. 7, the yoke has tabs 52 that extend into a pair of opposed cross tee slots 31. As seen in FIG. 8, a distal portion of the integral end connector 26 is manually cut off by the technician installing the ceiling grid so that it does not interfere with a web 54 of the associated main tee 12. The cross member 10 is positioned so that its flange 22 is coplanar with the main tee flange 32. At this position, the yoke tab 52 has a hole that registers with the oblong hole 38 of the cross member 10. A rivet or other fastener 56 is assembled through both the tab hole 53 and oblong hole 38 to lock these elements in their relative position.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A narrow channel assembly for use in a suspended ceiling grid comprising a pair of main runners held in parallel alignment on a yoke disposed around the top and sides of the channel, the yoke having tabs extending through opposed cross runner slots of the main runners into the channel, a cross member extending across the channel having a lower flange coplanar with a lower flange of the main runner, the cross runner having stamped apertures aligned with holes in said tabs, and fasteners assembled through said holes and apertures to lock said channel, cross member and yoke together.

2. A narrow channel assembly for use in a suspended ceiling grid comprising a pair of main runners each with a lower flange and with aligned cross runner slots in webs above the flanges, a sheet metal cross member, the cross member having a lower flange coplanar with the flange of the main runners, the cross member having a double ply web above its flange, an integral end connector at each end of the cross member, each integral end connector being formed of two plies and joined to the web, the integral end connectors being disposed in opposite said cross runner slots in the main runners, at least one of the integral end connectors having plies with portions that are effectively entirely flat at the respective receiving slot and are spread apart so that they lie in a plane generally parallel to the main runners on a side of the main runner opposite an interior of the channel to lock said cross runners in place between said main runners.

3. A method of constructing a narrow utility channel for a suspended ceiling comprising forming a channel with two main runners having longitudinally spaced opposed cross runner slots, assembling an inverted U-shaped yoke outside and above the space formed by the main runners, the yoke having tabs assembled in a pair of opposed cross runner slots, and assembling a cross member in the channel, the cross member being provided with bendable integral end connectors, inserting a first of the end connectors in a first cross runner slot, bending a second of the end connectors to foreshorten the cross runner, rotating the cross member from a diagonal position to a perpendicular position while the bent integral end connector is progressively inserted into a second cross runner slot opposite said first cross runner slot.

* * * * *